US007017851B2

(12) United States Patent
Matsuura et al.

(10) Patent No.: US 7,017,851 B2
(45) Date of Patent: Mar. 28, 2006

(54) COIL BOBBIN STRUCTURE

(75) Inventors: Mutsumi Matsuura, Tokyo (JP); Genta Yoshii, Tokyo (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 10/720,563

(22) Filed: Nov. 24, 2003

(65) Prior Publication Data

US 2004/0155542 A1 Aug. 12, 2004

(30) Foreign Application Priority Data

Nov. 28, 2002 (JP) ..... 2002-345761

(51) Int. Cl.
*B21F 3/04* (2006.01)

(52) U.S. Cl. ..... 242/437; 336/192

(58) Field of Classification Search ..... 242/433, 242/436, 437; 336/192
See application file for complete search history.

(56) References Cited

U.S. PATENT DOCUMENTS

| | | | | |
|---|---|---|---|---|
| 4,254,911 | A | 3/1981 | Hait | |
| 4,588,973 | A * | 5/1986 | Grah et al. | 336/192 |
| 4,617,543 | A | 10/1986 | Akachi et al. | |
| 4,835,841 | A | 6/1989 | Gunnels et al. | |
| 5,600,294 | A | 2/1997 | Buenconsejo et al. | |
| 6,476,703 | B1 * | 11/2002 | Geltsch et al. | 336/192 |
| 6,559,749 | B1 * | 5/2003 | Weiner | 336/192 |
| 6,755,692 | B1 * | 6/2004 | Hsu | 439/620 |

FOREIGN PATENT DOCUMENTS

| | | |
|---|---|---|
| JP | 03268310 | 11/1991 |
| JP | 09224342 | 8/1997 |

* cited by examiner

*Primary Examiner*—Emmanuel Marcelo
(74) *Attorney, Agent, or Firm*—John J. Skinner, Jr.; Schulte Roth & Zabel

(57) ABSTRACT

To provide a coil bobbin structure that allows intersection of the wire to be avoided with a simple structure and improved reliability to be attained, while at the same time, allowing the possible use of automatic winding machines. In a coil bobbin 1 consisting of a bobbin main body 2 constituted by forming flanges 4 an 5 at both ends in the axial direction of a cylindrical winding drum portion 3, wherein at a portion of one of the flanges 4, a terminal support 6 is provided protruding in the outer direction of the diameter direction, said terminal support 6 being provided with 2 terminal pins 7 that are standing, at the same time, both ends of a magnet wire 9 that is wound around the outer circumference of the winding drum portion 3 of the bobbin main body 2, are respectively wound and fixed to the terminal pins 7, 2 terminal supports 6 are installed and the terminal pins 7 are provided respectively to each terminal support 6 so as to be standing, at the same time, a guide groove 6*a* is provided respectively to each terminal support 6, each extremity of the magnet wire 9 passes from the winding drum portion 3 through the gap between both terminal supports 6, is wound into each terminal support 6, passed through the guide groove 6*a*, is guided to the terminal pin 7 and is wound and fixed to said terminal pin 7.

3 Claims, 5 Drawing Sheets

COIL BOBBIN STRUCTURE

CROSS-REFERENCE TO RELATED APPLICATIONS

This application claims priority from Japanese Patent Application No. 2002-345761 filed on Nov. 28, 2002.

BACKGROUND OF THE INVENTION

1. Field of the Invention

The present invention relates to the structure of a coil bobbin used in rotary transformers and the like such as various motors and resolvers.

2. Description of the Related Art

As shown in FIG. 6, a coil bobbin 101 used in rotary transformers and the like such as various motors and resolvers, is constituted by forming flanges 104 and 105 at both ends in the axial direction of a cylindrical winding drum portion 103 of a bobbin main body 102, wherein at a portion of one of the flanges 104, a terminal support 106 is provided as a single piece protruding in the outer direction of the diameter direction, the terminal support 106 being provided with 2 terminal pins 107 that are standing, at the same time, both ends of a wire 109 that is wound around the outer circumference of the winding drum portion 103 of the bobbin main body 102, are respectively wound and fixed by soldering or the like to the terminal pin 107 (Refer to Patent Publication Hei.9-224342).

However, since in the coil bobbin 101 of the prior art shown in FIG. 6, a structure was adopted in which the extremities of the winding start and the winding ends of the wire 109 are directly wound and fixed to the terminal pins 107, the extremities of the winding start and the winding ends of the wire 109 rise to the terminal pins 107 as shown in the FIG., unavoidably generating a straight rising portion 109*a* that does not follow the arc, and particularly in a resolver and the like, in case said coil bobbin 101 is to be covered with an outer core made of metal (not shown), the rising portion 109*a* of the wire 109 contacts the outer core, causing difficulties.

Therefore, a structure was adopted, in which the extremities of the winding start and the winding ends of the wire 209 are intersect in an X-shape at the base end portion of the terminal support 206, as shown in FIG. 7 and FIG. 8 (partial perspective view in the direction of arrow E of FIG. 7).

However, there was the problem that when the extremity portions of the winding start and the winding ends of the wire 209 intersect as described above, the wire 209 contacts with itself at the intersection, and due to oscillations, shocks and the like, the coat at the contact portion of the wire 209 wears off, or scratches occur on wire 209, inducing deterioration of the insulating withstand voltage or short circuit.

Therefore, a structure as shown in FIG. 9 was proposed, which prevents intersection of the winding start and the winding ends of the wire. That is, FIG. 9 is a partial perspective view of the terminal portion of the coil bobbin 301, in which 2 terminal pins 307 are provided to the terminal support 306 so as to be standing in the horizontal direction, and at one portion of the terminal support 306, an engaging protrusion 306*a* and a guide protrusion 306*b* are formed integrally.

Therefore, one end 309*a* that is the winding start of the wire 309 wound around the coil bobbin 301 is guided along the guide groove 306*b*-1 formed in the protrusion 306*b* to one terminal pin 307, then wound and fixed to said terminal pin 307, the other end 309*b* that is the winding end of the wire 309 is hooked to the engaging protrusion 306*a* and guided to the other terminal pin 307, then wound and fixed to said terminal pin 307, such that according to this structure, crossing over of wire 309 can be avoided.

However, with the above-mentioned structure, since the shape of the coil bobbin 301 is complicated, there is the problem that automatic winding of wire 309 by automatic winding machines becomes difficult.

SUMMARY OF THE INVENTION

The problems enumerated so far provided the impetus for the present invention, and its object lies in providing a coil bobbin structure that allows intersection of the wire to be avoided with a simple structure and improvement of reliability to be devised, at the same time allows the possible use of automatic winding machines.

To achieve the invention's objective, the invention is characterized such that, in a coil bobbin consisting of a bobbin main body constituted by forming flanges at both ends in the axial direction of a cylindrical winding drum portion, wherein at a portion of one of the flanges, a terminal support is provided protruding in the outer direction of the diameter direction, the terminal support being provided with 2 terminal pins that are standing, at the same time, both ends of a wire that is wound around the outer circumference of the winding drum portion of the bobbin main body, are respectively wound and fixed to the terminal pins, 2 terminal supports mentioned previously are installed and the terminal pins are provided respectively to each terminal support so as to be standing, at the same time, a guide groove is provided respectively to each terminal support, each extremity of the wire passes from the winding drum portion through the gap between both terminal supports, is wound into each terminal support, passed through the guide groove, is guided to the terminal pin and is wound and fixed to said terminal pin.

Therefore, according to the invention, since each extremity of the wire is wound into each respectively independent terminal support, guided along the guide groove to each terminal pin, then wound and fixed to each terminal pin, crossing over of the wire can be avoided with a simple structure, improved of reliability can be obtained by avoiding insulation deterioration and short circuit At the same time, the use of automatic winding machines becomes The invention may also be in an embodiment such that the guide grooves are provided in opposing directions on both terminal supports.

In this embodiment, the length of winding to each terminal support of each extremity of the wire can be sufficiently secured, and the extremities of the wire can be reliably fixed to the terminal pins.

Furthermore, in either aforementioned embodiment of the invention, the guide grooves may be provided in the direction of the length of the terminal pins.

Therefore, in this configuration, each extremity portion of the wire can be guided without forcing along the guide groove in the direction of the length of the terminal pin and fixed to the terminal pin.

In any of the aforementioned embodiments, at the base end portion of each terminal support mentioned previously, a concave portion can be formed, which is where the guide groove opens.

Therefore, in this embodiment, each extremity of the wire can be guided, without forcing, from the concave portion formed at the base end of each terminal support along the guide groove to the terminal pin.

DETAILED DESCRIPTION

In the following, configurations of the present invention will be explained based on the attached FIGS.

Figure 1:
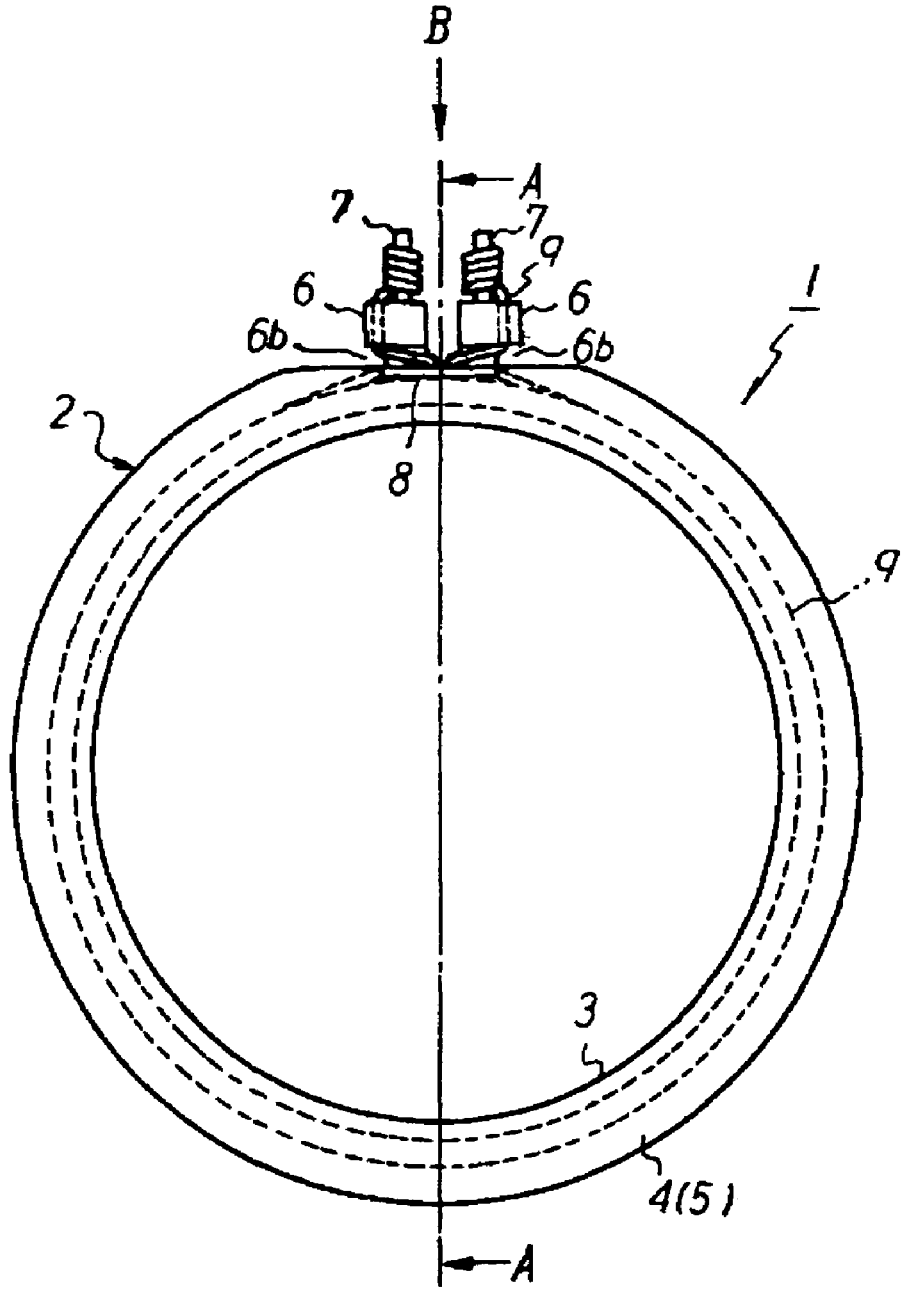
FIG. 1 is a front view of a coil bobbin equipped with a structure of the invention.
Figure 2:
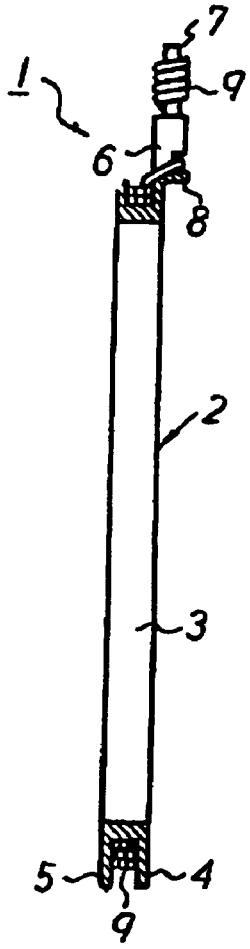
FIG. 2 is a cross sectional view along the A—A line of FIG. 1.
Figure 3:
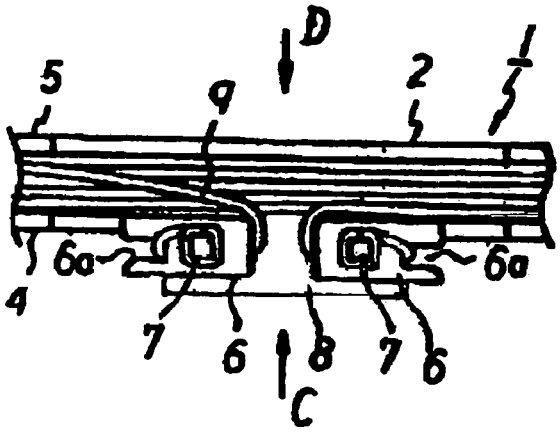
FIG. 3 is a view in the direction of the arrow B of FIG. 1.
Figure 4:
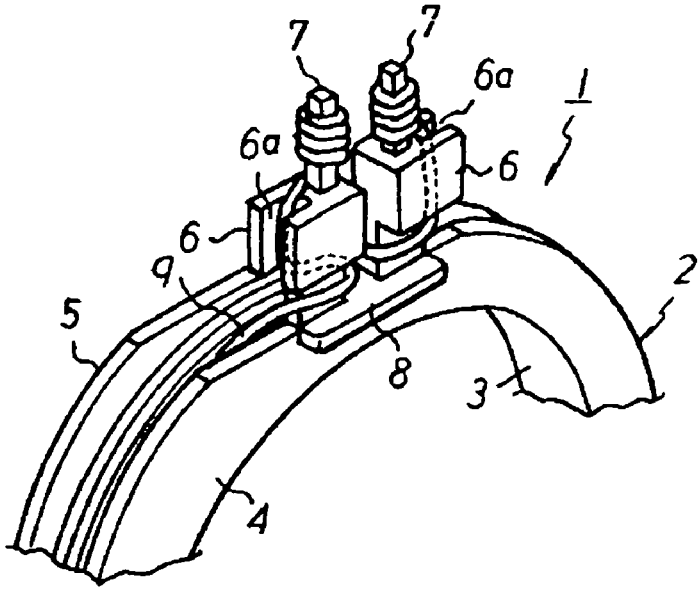
FIG. 4 is a partial perspective view in the direction of the arrow C of FIG. 3.
Figure 5:
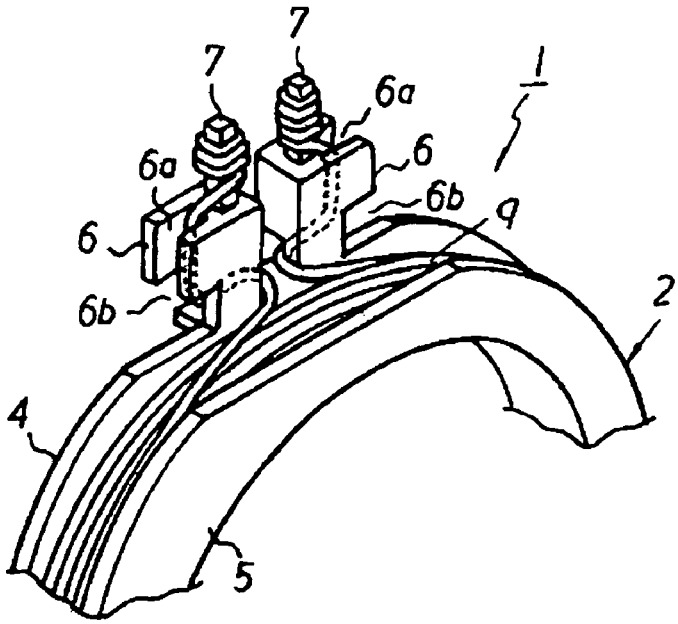
FIG. 5 is a partial perspective view in the direction of the arrow D of FIG. 3.
Figure 6:
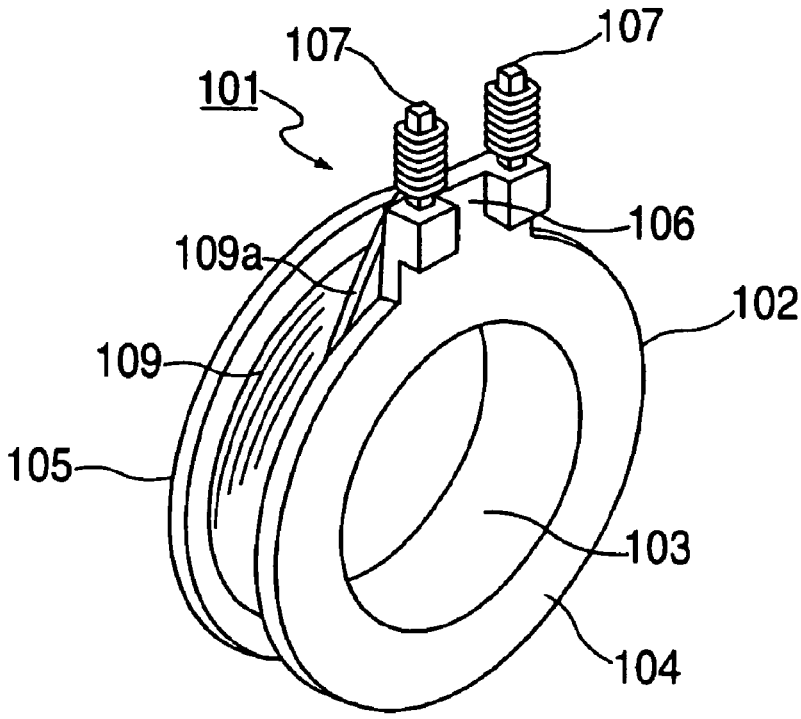
FIG. 6 PRIOR ART
FIG. 6 is a perspective view of a coil bobbin related to a first example of the prior art.
Figure 7:
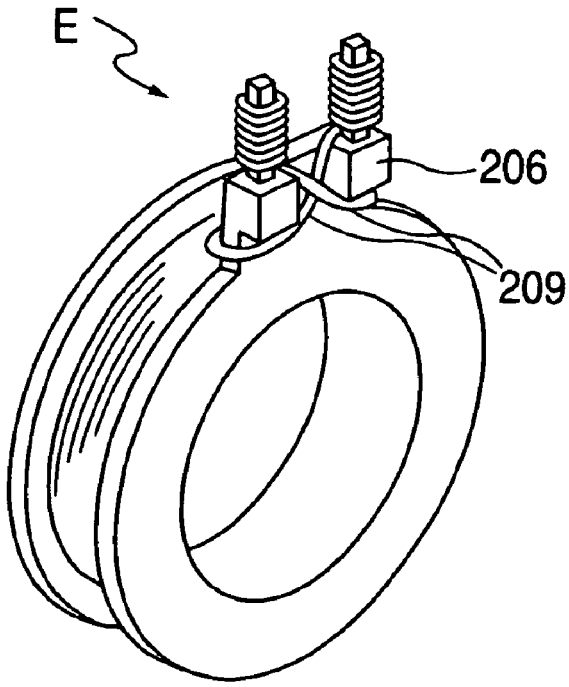
FIG. 7 PRIOR ART
FIG. 7 is a perspective view of a coil bobbin related to a second example of the prior art.
Figure 8:
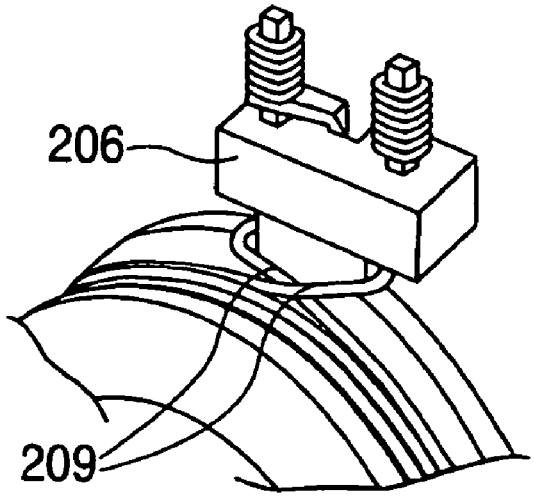
FIG. 8 PRIOR ART
FIG. 8 is a view in the direction of the arrow E of FIG. 7.
Figure 9:
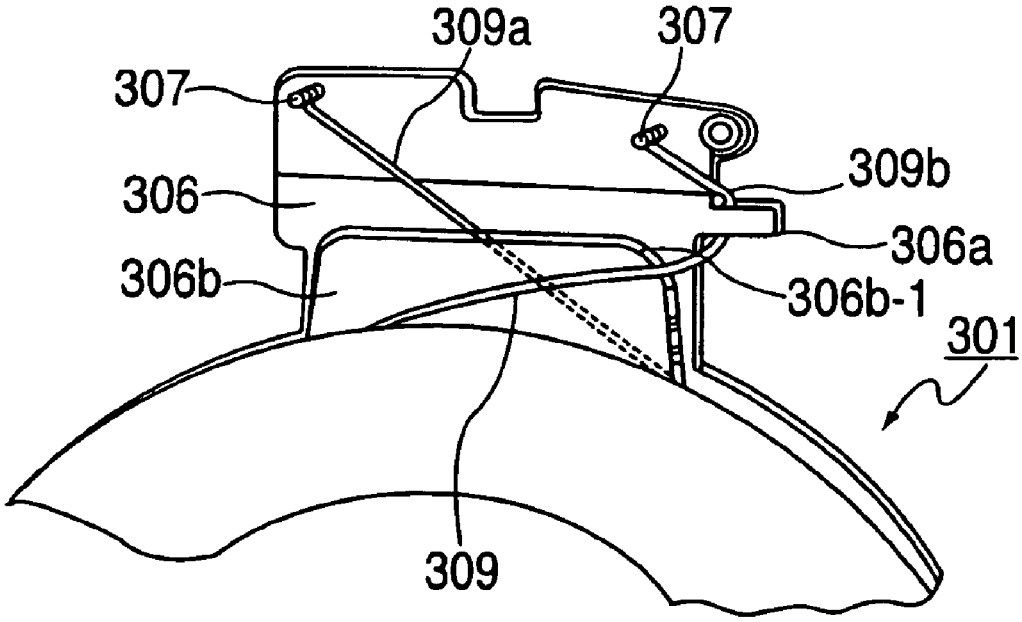
FIG. 9 PRIOR ART
FIG. 9 is a partial perspective view of a coil bobbin related to a third example of the prior art.

FIG. 1 is a front view of a coil bobbin equipped with the structure of the present invention, FIG. 2 is a cross sectional view along the A—A line of FIG. 1, FIG. 3 is a view in the direction of arrow B of FIG. 1, FIG. 4 is a partial perspective view in the direction of arrow C of FIG. 3, FIG. 5 is a partial perspective view in the direction of arrow D of FIG. 3.

In the coil bobbin 1 shown in the FIGS., numeral 2 is a pulley shaped bobbin main body integrally molded in resin (for example nylon 46), and the bobbin main body 2 is formed by ring shaped flanges 4 and 5 having larger diameters than the winding drum portion 3, integrally formed at both ends in the axial direction of the cylindrical winding drum portion 3. Then, at the upper end of one of the flanges 4 of this bobbin main body 2, 2 terminal supports 6, left and right, are provided as a single piece so as to protrude in the outer direction of the diameter direction (upper direction), a terminal pin 7 made of metal is hammered into each terminal support 6 and installed so as to be standing perpendicularly. In addition, at the base end portion of the terminal support 6 of one of the flanges 4, a receiving portion 8 is installed horizontally so as to be protruding.

In fact, a gap is formed between the 2 terminal supports 6, and in the opposite directions of each terminal support 6 (outer edge surface), guide grooves 6*a* are provided in the upper and the lower directions (the direction of the length of the terminal pins 7). Then, a concave portion 6*b* is formed at the base end portion of each terminal support 6, and the guide groove 6*a* opens into this concave portion 6*b*.

Therefore, at the outer circumference of the winding drum portion 3 of the bobbin main body 2, a magnet wire 9 is wound several turns, and each extremity of its winding start and winding end is wound and fixed to each terminal pin 7 as follows.

That is, each extremity of the winding start and the winding ends of the magnet wire 9 is pulled outwards from the winding drum portion 3 of the bobbin main body 2, passing through the gap between both terminal supports 6, wound following the outer circumference of the base end portion of the terminal support 6, reaches the concave portion 6*b*, and while guided by the guide groove 6*a* that opens into said concave portion 6*b*, extends from the lower direction to the upper direction and is guided to the terminal pin 7, wound around the outer circumference of said terminal pin 7 and fixed by a means such as soldering or its like.

As indicated above, according to the structure of the coil bobbin 1 related to the present configuration, since each extremity of the magnet wire 9 is wound to each terminal support 6, is guided along each independent guide groove 6*a* to each terminal pin 7, and wound and fixed to each terminal pin 7, intersection of magnet wire 9 can be avoided with a simple structure, the magnet wire 9 does not contact with itself due to oscillations, shocks and the like, deterioration of the insulation or occurrence of short circuits caused by the wearing and scratching of the coat on said magnet wire 9 is avoided such that improvement of the reliability of the coil bobbin 1 of interest can be obtained.

In addition, since the shape of the coil bobbin 1 is not complicated, automatic winding of the magnet wire 9 using an automatic winding machine becomes possible.

Furthermore, in the coil bobbin 1 related to the present configuration, since guide grooves 6*a* are provided in opposing directions to both terminal supports 6 (outer edge surface), length of winding to each terminal support 6 of each extremity of the magnet wire 9 can be secured sufficiently, and the extremities of said magnet wire 9 can be reliably fixed to the terminal pin 7. Then, since the guide groove 6*a* is provided in the direction of the length of the terminal pin 7 (in the upper and the lower directions), each extremity of the magnet wire 9 can be guided, without forcing, along the guide groove 6*a* in the direction of the length of the terminal pin 7 and fixed to the terminal pin 7.

In addition, since at the base end portion of each terminal support 6, a concave portion 6*b* is formed, which is where the guide groove 6*a* opens, each extremity of the magnet wire 9 can be guided without forcing from the concave portion 6*b* along the guide groove 6*a* until terminal pin 7.

As it is clear from the above description, according to the present invention, since in a coil bobbin consisting of a bobbin main body formed by forming flanges at both ends in the axial direction of a cylindrical winding drum portion, wherein at a portion of one of the flanges, a terminal support is provided protruding in the outer direction of the diameter direction, said terminal support being provided with 2 terminal pins that are standing, at the same time, both ends of a wire that is wound around the outer circumference of the winding drum portion of the bobbin main body, are respectively wound and fixed to the terminal pins, 2 terminal supports mentioned previously are installed and the terminal pins are provided respectively to each terminal support so as to be standing, at the same time, a guide groove is provided respectively to each terminal support, each extremity of the wire passes from the winding drum portion through the gap between both terminal supports, is wound into each terminal support, is passed through the guide groove, is guided to the terminal pin and is wound and fixed to said terminal pin, the effect is obtained that, by avoiding the intersection of the wire with a simple structure, improved reliability can be attained, and at the same time, the use of automatic winding machines becomes possible.

What is claimed is:

1. An apparatus for a coil bobbin comprising:

a bobbin main body having flanges at both ends in the axial direction of a cylindrical winding drum portion;

two terminal supports, at a portion of one of the flanges protruding in the outer direction of the diameter direction, with a gap between the two terminal supports, said terminal supports being provided with two terminal pins that are standing;

a wire that is wound around the outer circumference of the winding drum portion of the bobbin main body, each end of which are respectively wound and fixed to the terminal pins;

a coil bobbin structure in that the two terminal supports are installed and the terminal pins are provided respectively to each terminal support so as to be standing; and a guide groove is provided in the direction of the length of the terminal pin in opposing directions respectively to each terminal support, a receiving portion, installed horizontally at a base end portion of each terminal support, to provide for a concave portion to connect to where the guide groove opens, and wherein each extremity of the wire passes from the winding drum portion through the gap between both terminal supports, is wound into each terminal support, passed through the guide groove, is guided to the terminal pin and is wound and fixed to the terminal pin.

2. The apparatus according to claim 1 wherein the concave portion is formed where the guide groove opens at the base end portion of each terminal support.

3. The apparatus according to claim 1 wherein when the wire is wound into each terminal support it is wound through the concave portion before passing through the guide groove.

* * * * *